US007318990B2

(12) United States Patent
Makino et al.

(10) Patent No.: US 7,318,990 B2
(45) Date of Patent: Jan. 15, 2008

(54) TONER, DEVELOPER, IMAGE FORMING METHOD, IMAGE FORMING APPARATUS AND TONER MANUFACTURING METHOD

(75) Inventors: Nobuyasu Makino, Numazu (JP); Masakazu Nakada, Numazu (JP); Tohru Suganuma, Numazu (JP); Fumitoshi Murakami, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 439 days.

(21) Appl. No.: 11/009,129

(22) Filed: Dec. 13, 2004

(65) Prior Publication Data

US 2005/0158648 A1 Jul. 21, 2005

(30) Foreign Application Priority Data

Dec. 12, 2003 (JP) ..... 2003-415432
Dec. 1, 2004 (JP) ..... 2004-348918

(51) Int. Cl.
*G03G 9/08* (2006.01)

(52) U.S. Cl. ..... 430/110.4; 430/110.3

(58) Field of Classification Search ..... 430/110.4, 430/110.1, 110.3
See application file for complete search history.

(56) References Cited

U.S. PATENT DOCUMENTS 5,437,949 A * 8/1995 Kanbayashi et al. ..... 430/110.4
5,618,647 A * 4/1997 Kukimoto et al. ..... 430/106.1
6,238,834 B1 * 5/2001 Tamura et al. ..... 430/106.1
6,368,765 B2 4/2002 Izu et al.
6,503,681 B2 1/2003 Makino et al.
2003/0178514 A1 9/2003 Makino et al.

FOREIGN PATENT DOCUMENTS

| | | |
|---|---|---|
| JP | 63-197962 | 8/1988 |
| JP | 02-000877 | 1/1990 |
| JP | 03-002763 | 1/1991 |
| JP | 05-297631 | 11/1993 |
| JP | 05-313414 | 11/1993 |
| JP | 06-003853 | 1/1994 |

OTHER PUBLICATIONS

U.S. Appl. No. 10/848,062, filed May 19, 2004, Murakami et al.

* cited by examiner

*Primary Examiner*—Hoa Van Le
(74) *Attorney, Agent, or Firm*—Oblon, Spivak, McClelland, Maier & Neustadt, P.C.

(57) ABSTRACT

A toner includes toner particles which have a binder resin and a colorant. The toner has a weight average particle diameter of from 4 to 7 μm and includes toner particles having a circle equivalent diameter of from 0.6 to 2.0 μm in an amount not greater than 5% by quantity, toner particles having a particle diameter of from 3.17 to 4.00 μm in an amount of from 10 to 40% by quantity, toner particles having a diameter of from 4.00 to 5.04 μm in an amount of from 20 to 40% by quantity, and toner particles having a diameter not less than 12.7 μm in an amount of from 0 to 1.0% by weight. The toner satisfies the following relationship: $1.04 \leqq D4/D1 \leqq 1.30$, wherein D4 represents the weight average particle diameter and D1 represents a number average particle diameter of the toner.

17 Claims, 3 Drawing Sheets

TONER, DEVELOPER, IMAGE FORMING METHOD, IMAGE FORMING APPARATUS AND TONER MANUFACTURING METHOD

BACKGROUND OF THE INVENTION

1. Field of the Invention

The present invention relates to a toner for use in electrophotographic image forming method adopted in, for example, photocopiers, printers and facsimile machines. The preset invention further relates to a developer comprising the toner, and an image forming method using the toner. The present invention also relates to a method of manufacturing the toner, and an image forming apparatus and a process cartridge using the toner.

2. Discussion of the Background

Recently, the printing and copying volume of graphic documents, such as photographs, has been increasing in addition to that of conventional letter documents with as computers, networking and digitization of information are increasingly used.

Additionally, toner particles have been reduced in size to satisfy demands on improvement in quality of images printed by electrophotography. Further, in order to prepare a toner which can be used for high speed printing, resins having a low softening point are used therefor so that the resultant toner can be quickly respond to heat in fixing. Therefore various kinds of toner manufacturing methods have been studied.

Quality of images printed in electrophotography has been recently improved and is now close to that obtained by using silver-salt films. Therefore, there is an increasing demand for having an average particle diameter of from 4 to 6 μm and a sharp distribution. Commercializing such a toner using a polymerization method has been studied.

Polymerized toners apparently are able to be manufactured with less energy and less burden on the environment, because the amount of $CO_2$ emission is relatively small compared with the conventional toner manufacturing process that includes the steps of kneading, pulverization and classification. However, when a polymerized toner is manufactured, a large amount of water is consumed in the process of granulating particles and a large amount of energy is consumed. Therefore, it is not necessarily the case that a polymerized toner can be manufactured with less burden on the environment. In addition, often a large plant is used for manufacturing a polymerized toner, resulting in increase in its initial cost. Therefore, manufacturing a polymerized toner is not economically feasible unless the same polymerized toner is mass produced for a relatively long period of time.

In addition, with improvement in the function of hardware for use in electrophotography such as copiers, printers and facsimile machines, the toner and developer supplied for such improved hardware have also been improved. However, since a toner manufactured by a polymerization method is difficult to improve except for changing external additives, the toner is not always compatible with the improved hardware. When changing materials used for manufacturing a toner by a polymerization method, manufacturing conditions are usually studied for some time and therefore an immediate adoption of a new toner having a high level of function is difficult.

As for a toner manufactured by a pulverization method, pulverizers capable of efficiently producing a small-sized toner particle having an average particle diameter of from 4 to 6 μm have been studied. It is known to pulverize toner with collision board pulverizers, mechanical pulverizers and counter air pulverizers.

Among the pulverizers mentioned above, mechanical pulverizers and counter air pulverizers are preferably used for manufacturing toners having a small particle.

Mechanical pulverizers are also referred to as impact pulverizers. Particles are pulverized in the mechanical pulverizer when particles collide with each other in a violent current of airflow created by a pulverizing rotor rotating at a high speed.

Specific examples of mechanical pulverizers include KRYPTRON® (manufactured by Kawasaki Heavy Industries, LTD.), TURBO MILL™ (manufactured by Turbo Kogyo CO., Ltd.), and ACM® PULVERIZER and INNOMIZER® (manufactured by Hosokwa Micron Corporation).

Counter air pulverizers are also referred to as air jet pulverizers. Particles are pulverized in counter air pulverizers when particles collide with each other in a counter air jet.

Specific examples of counter air pulverizers include PJM-I (manufactured by Nippon pneumatic MFG. Co., Ltd.), MICRON JET MILL® and COUNTER JET MILL® manufactured by Hosokawa Micron Corporation), and CROSS JET® mill (manufactured by Kurimoto Ltd.).

Among these pulverizers, the counter air pulverizers pulverize particles by collision between particles, and therefore pulverization occurs at particle surface. Thus, the surfaces of particles are shaven and loses their jaggedness, such that substantially round toner particles are obtained. As the contact area of such round toner particles is small, the round toner particles have characteristics such as weak adhesion strength, excellent transferability and good replenishing properties. Considering these points, counter air pulverizes have an advantage over other pulverizers.

However, the inventors of the present invention have studied counter air pulverizers and found that an extremely large amount of super fine powder having a diameter not greater than 2 μm are formed as a result of surface pulverization.

Japanese Patent No. (hereinafter referred to as JP-B) 2896829 discloses a toner capable of producing clear and sharp images, which includes a specific amount of small sized toner particles. It is described therein that the toner is not substantially adhered to a development sleeve, and thereby problems such as background fouling and toner scattering occur.

Specifically, the toner includes toner particles having a particle diameter of from 2.00 to 4.00 μm and from 4.00 to 5.04 μm in an amount of from 3 to 15% by quantity and 8 to 19% by quantity, respectively. JP-B 2896829 also describes that deterioration of image definition can be restrained by appropriately controlling the toner particle distribution.

Further, JP-B 2896826 discloses a toner capable of producing images with high image density and excellent fine line reproducibility and gradation property even when used for image forming apparatus equipped with a toner recycle system. It is described therein that, by using a toner having a specific amount of fine toner particles and coarse toner particles, high quality images can be continuously produced.

Specifically, the toner has toner particles having a particle diameter of from 2.00 to 4.00 μm and from 4.00 to 5.04 μm in an amount of from 3 to 15% by quantity and 8 to 19% by quantity, respectively. Further JP-B 2896826 describes that images with good fine line reproducibility are produced by using a toner including toner particles having a particle diameter not greater than 12.7 μm in an amount of not greater than 10% by volume.

Further, JP-B 2694558 discloses a toner capable of producing images which have high image density and are excellent in fine line reproducibility and highlight gradation.

Specifically, it is described therein that, by using a toner containing toner particles having a particle diameter not greater than 5 μm in an amount of from 8 to 40% by quantity, images with excellent fine dot reproducibility and good image quality can be continuously produced. Further JP-B 2694558 describes that a toner containing toner particles having a particle diameter of from 12.7 to 16.0 μm in an amount of from 0.1 to 15.0% by volume can maintain good fluidity.

Furthermore, JP-B 2763318 discloses a non-magnetic toner for use in a two component developer, which can produce images with high image density, and excellent fine line reproducibility and gradation property.

Specifically, it is described in JP-B 2763318 that the non-magnetic toner includes toner particles having a particle diameter not greater than 5 μm in an amount of from 17 to 60% by quantity, particles having a particle diameter of from 8 to 12.7 μm in an amount of 1 to 30% by quantity, and particles having a particle diameter not less than 16 μm in an amount of not greater than 2% by volume. Further, the non-magnetic toner has a volume average particle diameter of from 4 to 10 μm. The toner also satisfies the relationship: $N/V=0.04N+k$, wherein N represents the percentage by quantity of the toner particles having a particle diameter not greater than 5 μm and is a number in the range of from 17 to 60, V represents the percentage by volume of the toner particles having a particle diameter not greater than 5 μm, and k represents a number in the range of from 4.5 to 6.5.

As prior art focusing on the toner pulverization method, unexamined published Japanese Patent Application No. (hereinafter referred to as JOP) 8-10350 discloses a toner pulverizing method which can manufacture a toner without causing toner adhesion and toner fusion bonding in a pulverizer, and which is efficient in terms of power consumption. The toner pulverizing method includes the steps of preliminary pulverizing a toner composition mixture with a mechanical pulverizer to obtain a toner powder having a particle diameter of from 20 to 60 μm, and then pulverizing the toner powder with a counter air pulverizer to prepare the toner.

In attempting to improve the product yield of a toner in the pulverization and the granulation steps, JOP 5-313414 discloses a toner manufacturing method including the steps of preliminarily pulverizing a toner composition mixture with a mechanical pulverizer to obtain a toner powder having an average particle diameter of from 20 to 100 μm.

While the methods described in JOPs 8-10350 and 5-343414 are effective in solving some problems in toner manufacturing mentioned above, the quality of images produced by the toners obtained by theses methods is inferior to that in the case where a toner manufactured by polymerization is used.

The inventors of the present invention have studied conventional toner manufacturing methods and have found that, when a small-sized toner having a toner particle of from 4 to 6 μm is manufactured by a conventional method, the main problem which occurs is that super fine toner particles having a particle diameter not greater than 2 μm is present in a large amount.

Such super fine toner particles having a particle diameter not greater than 2 μm causes the following problems even when the content thereof is low.

(1) Even when the content of super fine toner particles having a particle diameter not greater then 2 μm is low, the super fine toner particles cover the surface of a carrier particle so completely as to lower the chargeability of the carrier, and thereby the furnished toner particles cannot be charged sufficiently. As a result, a problem occurs in that the toner scatters when images are sequentially output.

(2) The super fine toner particles having a particle diameter not greater than 2 μm are extremely small and thus tend to strongly adhere to carrier particles, resulting in formation of spent toner on the carrier particles, thereby deteriorating the charging ability of the developer containing the toner.

(3) The super fine toner particles having a particle diameter not greater than 2 μm tend to form a film on an image bearing member, a developing sleeve, etc.

(4) It is well known that, when large coarse toner particles are present, isolated dot images are not exactly reproduced in the developing process and the transfer process and resultingly the images obtained look rough, i.e., images having non-uniform density. The inventors of the present invention have found that faithful reproduction of such isolated dots in the developing process is obstructed by the super fine toner particles having a particle diameter not greater than 2 μm. Although the cause of this phenomenon is unclear, it is believed that the super fine toner particles having a particle diameter not greater than 2 μm are extremely different in terms of adhesion strength and charging ability, etc. Therefore, the super fine toner particles may affect behaviors of other toner particles and cause non-uniform reproduction of isolated dots at the time of development especially when the super fine toner particles adhere to an image bearing member.

In a toner manufacturing method using the conventional pulverization mentioned above, these problems are not satisfactorily solved.

When a toner having an average particle diameter of from 4 to 6 μm is manufactured by a toner manufacturing method using the conventional pulverization mentioned above, its particle diameter is small so that the quality of images obtained is improved to a certain degree. However, the quality of images obtained is not comparable to that of the images obtained by a toner manufactured by a polymerization method. This is considered to be because super fine toner particles having a particle diameter not greater than 2 μm are present.

Now the reason why super fine toner particles having a particle diameter not greater than 2 μm are difficult to remove by classification is described with reference to FIG. 1.

A particle m receives a centrifugal force F by an air stream created by rotation of a classification rotor. The velocity V of air stream created by the rotation is determined by the radius r of the classification rotor and the number of rotation R of the rotor. In the case of a toner particle having a small toner particle diameter, the particle m is small and therefore hardly receives the centrifugal force F. Thus a toner having a small particle diameter is not well classified.

Especially, a super fine toner particle having a toner particle diameter not greater than 2 μm is hardly influenced by the centrifugal force F, and therefore is not sufficiently removed even in a fine particle classification process following the above classification.

According to the studies by the inventors of the present invention, among the conventional toner manufacturing methods mentioned above, especially the pulverization method using a counter air pulverizer produces a great amount of super fine powder having a particle diameter not greater than 2 μm at the time of pulverization. Therefore it is extremely difficult to eliminate the super fine toner particles in the fine powder classification process performed after the classification process.

This is not only simply because the toner particle is small sized, but also because it is believed that charge sites present on the surface of a pulverized toner particle are removed by a counter air pulverizer. Thus the resultant super fine toner particles tend to have an extremely large amount of charge and strong adhesion properties relative to super fine toner particles produced by other pulverization methods.

The problem discussed above caused by super fine powder having a particle diameter not greater than 2 μm is a serious problem especially for high speed continuous image outputs and color image outputs.

Specifically, when a high speed continuous printing is performed, isolated dot toner images on an image bearing member tend to be destroyed, such that the granularity of the toner images deteriorates, resulting in deterioration of image quality.

In addition, replenished toner particles have insufficient charging properties, which leads to decrease in image density, deterioration in fine line reproducibility and occurrence of background fouling.

Further, since four color toner layers are overlaid in forming a color image, the problem mentioned above becomes serious, and image quality seriously deteriorates.

The toner manufactured by counter air pulverization has a rounded form. Therefore, theoretically, the toner is expected to have good transferability which is comparable to that of a toner manufactured by polymerization. However, when toner particles having an average particle diameter of from 4 to 6 μm are manufactured, super fine toner powder having a particle diameter not greater than 2 μm inhibits improvement of image quality. Therefore, it is believed that elimination of such super fine toner powder having a particle diameter not greater than 2 μm will lead to improvement on the quality of images produced using a toner manufactured by pulverization.

Because of these reasons, a toner is described which is manufactured by pulverization, but from which super fine powder having a particle diameter not greater than 2 μm is eliminated, to an extent such that toner image quality is improved and the toner can be used for the progressed hardware for use in electrophotography.

SUMMARY OF THE INVENTION

Accordingly, an object of the present invention is to provide a toner manufactured by a pulverization method, which can produce images having good image quality in terms of granularity, density uniformity, definition and/or background fouling even at a high speed continuous image output operation.

Another object of the present invention is to provide a developer which can produce the quality images discussed above even at a high speed continuous image output operation.

Yet another object of the present invention is to provide an image forming method, an image forming apparatus and a process cartridge by which quality images as discussed above can be produced even at a high speed continuous image output operation.

A further object of the present invention is to provide a method of manufacturing the toner, by which the toner discussed above can be easily and stably produced.

Briefly these objects and/or other objects that will become more readily apparent can be attained by a toner including toner particles having a binder resin and a colorant. The toner has a weight average particle diameter of from 4 to 7 μm and includes toner particles having a circle equivalent diameter of from 0.6 to 2.0 μm in an amount not greater than 5% by quantity, toner particles having a particle diameter of from 3.17 to 4.00 μm in an amount of from 10 to 40% by quantity, toner particles having a diameter of from 4.00 to 5.04 μm in an amount of from 20 to 40% by quantity, and toner particles having a diameter not less than 12.7 μm in an amount of from 0 to 1.0% by weight. In addition, the toner satisfies the following relationship: $1.04 \leqq D4/D1 \leqq 1.30$, wherein D4 and D1 represent the weight average particle diameter and a number average particle diameter of the toner, respectively.

It is preferred that, for the toner mentioned above, an average circularity of toner particles having a circle equivalent diameter not less than 0.60 μm and less than 159.21 μm is from 0.92 to 0.97.

It is still further preferred that the toner mentioned above further includes an external additive having silica and/or titanium oxide.

It is still further preferred that the toner mentioned above is prepared by a method including the steps of mixing the binder resin and the colorant to obtain a toner composition mixture, kneading the toner composition mixture, pulverizing the kneaded toner composition mixture with a counter air pulverizer to obtain toner powder, and classifying the toner powder to obtain the toner.

It is still further preferred that the classifying mentioned above includes the steps of supplying the toner powder into a classification room formed by a classification cover having a first conical form and a classification board having a second conical form disposed under the classification cover and supplying air through an air inlet formed in each of a plurality of louvers. The louvers are circularly arranged between an undersurface of the first conical form of the classification cover and a top surface of the second conical form of the classification board at an outer circumference of the classifying room. The toner powder is whirled in the classification room by the air supplied. By using a centrifugal force, a coarse toner powder is discharged through a coarse toner powder discharging mouth formed around the classifying board and a fine toner powder is discharged from a fine toner powder discharging tube connected to a center of the classifying board.

It is still further preferred that fine toner powder produced in the pulverization or the classification step is reused as the toner composition mixture in the kneading step.

It is still further preferred that the method mentioned above further includes mechanically pulverizing the toner composition mixture prior to the counter air pulverization to obtain a toner powder.

It is still further preferred that the toner powder obtained at the mechanical pulverization has at least one of a weight average particle diameter and a mode particle diameter in the range of from 5 to 15 μm.

As another aspect of the present invention, a developer is provided which includes the toner mentioned above and a carrier, the surface of the carrier coated with a silicone resin including a silane coupling agent.

As another aspect of the present invention, an image forming method is provided which includes the steps of forming a latent image on a latent image bearing member, developing the latent image with a developer having the toner mentioned above to form a toner image on the latent image bearing member, transferring the toner image on the latent image bearing member to a transfer material and then cleaning the latent image bearing member.

As another aspect of the present invention, an image forming apparatus has a latent image bearing member configured to bear a latent image, a developing device configured to develop the latent image with a developer comprising the toner mentioned above to form a toner image on the latent image bearing member, a transfer device configured to transfer the toner image on the latent image bearing member to a transfer material and a cleaning device configured to clean the latent image bearing member.

As another aspect of the present invention, a process cartridge is provided which includes an image bearing member configured to bear a latent image, and a developing device to develop the latent image with the toner mentioned above. The process cartridge is detachably attachable to an image forming apparatus.

As another aspect of the present invention, a toner manufacturing method is provided which comprises the steps of mixing raw materials comprising a binder resin and a colorant to obtain a toner composition mixture, kneading the toner composition mixture, pulverizing the kneaded toner composition mixture with a counter air pulverizer to obtain a toner powder, and classifying the toner powder to obtain the toner. The toner has a weight average particle diameter of from 4 to 7 μm and includes toner particles having a circle equivalent diameter of from 0.6 to 2.0 μm in an amount not greater than 5% by quantity, toner particles having a particle diameter of from 3.17 to 4.00 μm in an amount of from 10 to 40% by quantity, toner particles having a diameter of from 4.00 to 5.04 μm in an amount of from 20 to 40% by quantity, and toner particles having a diameter not less than 12.7 μm in an amount of from 0 to 1.0% by weight. In addition, the toner satisfies the following relationship: $1.04 \leqq D4/D1 \leqq 1.30$, wherein D4 and D1 represent the weight average particle diameter and a number average particle diameter of the toner, respectively.

It is also preferred that, in the toner manufacturing method mentioned above, fine toner powder produced in the pulverization or the classification step is reused as the toner composition mixture in the kneading step.

It is still further preferred that the toner manufacturing method mentioned above further includes mechanically pulverizing the toner composition mixture prior to the counter air pulverization to obtain a toner powder.

It is still further preferred that, in the toner manufacturing method mentioned above, the toner powder obtained at the mechanical pulverization has at least one of a weight average particle diameter and a mode particle diameter in the range of from 5 to 15 μm.

It is still further preferred that, in the toner manufacturing method mentioned above, the classifying includes the steps of supplying the toner powder into a classification room formed by a classification cover having a first conical form and a classification board having a second conical form disposed under the classification cover, and supplying air through an air inlet formed in each of a plurality of louvers. The louvers are circularly arranged between an undersurface of the first conical form of the classification cover and a top surface of the second conical form of the classification board at an outer circumference of the classifying room. The toner powder is whirled in the classification room by the air supplied. By using a centrifugal force, a coarse toner powder is discharged through a coarse toner powder discharging mouth formed around the classifying board and a fine toner powder is discharged from a fine toner powder discharging tube connected to a center of the classifying board.

These and/or other objects, features and advantages of the present invention will become apparent upon consideration of the following description of the preferred embodiments of the present invention taken in conjunction with the accompanying drawings.

BRIEF DESCRIPTION OF THE DRAWINGS

Various objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
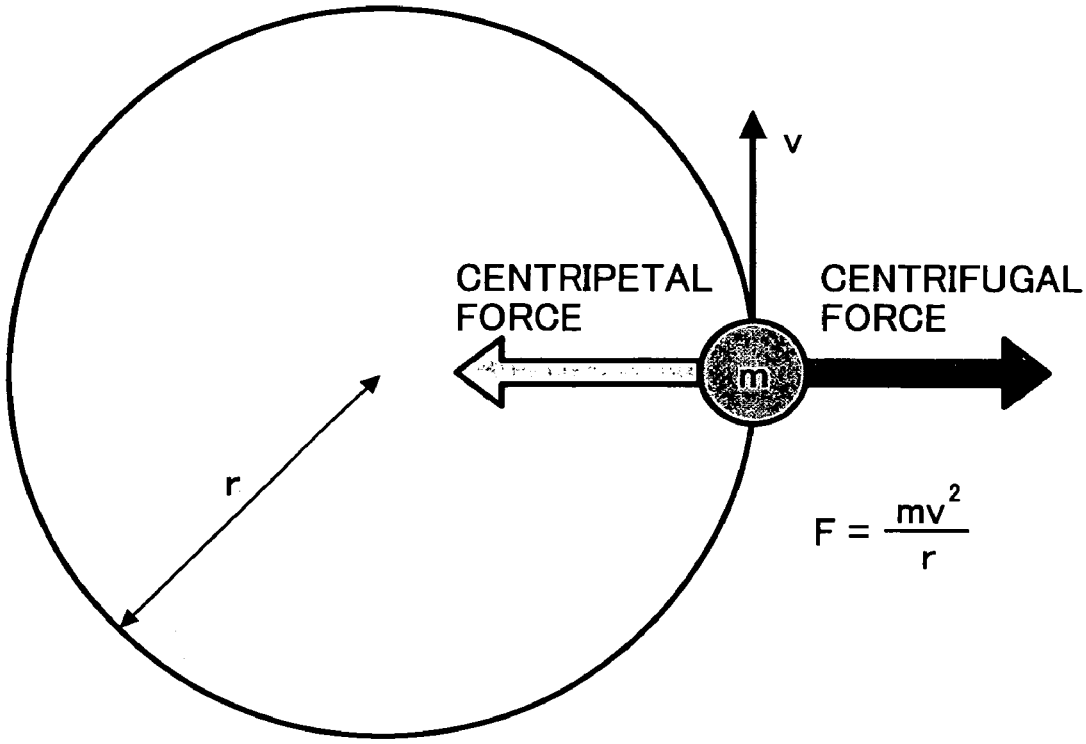
FIG. 1 is a diagram illustrating the relationship between a particle and power applied thereto when the particle is rotated by the rotation of a classification rotor.

The present invention is now described in detail with reference to several embodiments and accompanying drawings.

The toner of the present invention includes a binder resin and a colorant and is manufactured by a method including a pulverization process and a classification process. The toner includes toner particles having a circle equivalent particle diameter of from 0.6 to 2.0 μm in an amount of from 0 to 5% by quantity when measured with a flow particle image analyzer, and a weight average particle diameter of from 4 to 6 μm when measured by the Coulter method. In addition, the toner includes toner particles having a particle diameter of from 3.17 to 4.00 μm in an amount of from 10 to 40% by quantity, of from 4.00 to 5.04 μm in an amount of 20 to 40% by quantity and a large particle diameter not less than 12.7 μm in an amount of 0 to 1.0% by weight when measured by the Coulter method. Further, the ratio (D4/D1) of the weight average particle diameter (D4) of the toner to the number average particle diameter (D1) thereof, both of which are measured by the Coulter method, is from 1.04 to 1.30.

The toner of the present invention includes toner particles having a circle equivalent particle diameter of from 0.6 to 2.0 μm in an amount of not greater than 5% by quantity, and preferably not greater than 3% by quantity, when measured with a flow particle image analyzer. When this ratio is too large, image density deterioration, background fouling and granularity deterioration occur during a continuous image output operation.

In the present invention, the circle equivalent diameter of toner particles in the range of from 0.6 to 2.0 μm is measured by a flow particle image analyzer and the ratio of the toner particles in the toner is measured by the flow particle image analyzer.

The measuring method using a flow particle image analyzer is described below.

Toners, toner particles and external additives can be measured with a flow particle image analyzer, for example, FPIA-1000 (manufactured by Sysmex Corporation).

A measuring dispersant is prepared as follows.

(1) Remove fine impurities with a filter to obtain 10 ml of water which contains not greater than 20 particles having a particle diameter falling within a predetermined range (e.g., a circular equivalent particle diameter of from 0.60 to less than 159.21 μm) per $10^{-3}$ $cm^3$.

(2) After adding a few drops of a nonion surfactant (preferably CONTAMINON N manufactured by Wako Pure Chemical Industries) to the water, add 5 mg of a measuring sample thereto.

(3) The thus obtained water containing the measuring sample is subject to a dispersion treatment for one minute with a supersonic disperser (UH-50 manufactured by STM Corporation) under the conditions of 20 kHz and 50 W/10 $cm^3$, and to a further dispersion treatment for five minutes in total to obtain a dispersant in which the particle density of the measuring sample within the range of the measurement circle equivalent particle diameter (i.e., a circle equivalent particle diameter of from 0.60 to less than 159.21 μm) is from 4000 to 8000 particles per $10^{-3}$ $cm^3$.

The particle size distribution of the particles having a circle equivalent particle diameter of from 0.60 to less than 159.21 μm is measured as follows:

(1) Pass the measuring dispersant through the flow channel (wider along the flow direction) of a transparent flow cell having a flat form with a thickness of about 200 μm. A strobe and a CCD camera are disposed opposite each other with the flow cell therebetween so that the strobe and the CCD camera can form a light channel crossing the flow cell in the thickness direction thereof.

(2) Irradiate the flow cell with strobe light with an interval of 1/30 second to obtain images of particles flowing in the flow cell. As a result, the image of each particle is taken as a two-dimension image occupying a certain area in the flow cell along the parallel direction thereof.

(3) Calculate the diameter of a circle having an area corresponding to the two dimensional image area of each particle as the circle equivalent diameter of each particle.

Circle equivalent particle diameters can be calculated for at least 1,200 particles in about a minute. The number based on the circle equivalent particle diameter distribution and the ratio (% by quantity) of the particles having a circle equivalent diameter within a predetermined range is obtained.

The result (frequency % and accumulation %) is obtained by dividing the range into 226 channels. The actual particle size measurement is performed for toner particles having a circle equivalent diameter from 0.60 μm to less than 159.21 μm.

The toner of the present invention has a weight average particle diameter of from 4 to 7 μm, and preferably from 4 to 6 μm, when measured by the Coulter method.

When the weight average diameter of a toner is slightly too large, its granularity slightly deteriorates.

When the weight average diameter of a toner is grossly too large, it may be impossible to obtain a sufficient definition level, and its granularity deteriorates.

The toner of the present invention includes toner particles having a particle diameter of from 3.17 to 4.00 μm, from 4.00 to 5.04 μm and not less than 12.7 μm (i.e., a coarse and large particle) in an amount of 10 to 40% by quantity, 20 to 40% by quantity and 0 to 1.0% by weight, respectively, when measured with the Coulter method.

When the toner includes fine toner particles having a diameter of from 3.17 to 4.00 μm and/or a diameter of from 4.00 to 5.04 μm in too small an amount, the image obtained using the toner is not uniform with regard to density, and its granularity deteriorates.

When the toner includes fine toner particles having a diameter of from 3.17 to 4.00 μm and/or a diameter of from 4.00 to 5.04 μm in too large an amount, background fouling occurs during a continuous image output operation.

The toner preferably includes fine toner particles having a diameter of from 3.17 to 4.00 μm and of from 4.00 to 5.04 μm in an amount of from 15 to 35% by quantity and from 25 to 35% by quantity, respectively.

When the toner includes coarse toner particles having a particle diameter not less than 12.7 μm in too large an amount, its granularity deteriorates. The toner preferably includes coarse toner particles having a particle diameter not less than 12.7 μm in an amount of from 0 to 0.5% by weight.

The ratio (D4/D1) is from 1.04 to 1.30, and preferably from 1.04 to 1.20, wherein D4 and D1 represent a weight average particle diameter and a number average particle diameter, respectively, of the toner of the present invention measured by the Coulter method.

When the ratio (D4/D1) is too large, the particle size distribution of the toner is broad and thus isolated dots are not sufficiently covered by toner particles. Therefore isolated dots in an image are not properly reproduced and granularity of the toner particles deteriorates after the developing process and the transfer process deteriorates, resulting in images having non-uniform density.

Specific examples of devices measuring particle size distribution of toner particles using the Coulter method include Coulter Counter TA-II and Coulter Multisizer II (both are manufactured by Beckman Coulter Inc.). The measuring method is described below.

(1) Add 0.1 to 5 ml of a surface active agent (preferably a salt of an alkyl benzene sulfide) as a dispersant to 100 to 150 ml of an electrolytic aqueous solution. The electrolytic aqueous solution is an about 1% NaCl aqueous solution prepared by using primary NaCl (e.g., ISOTON-II®, manufactured by Beckman Coulter Inc.).

(2) Add 2 to 20 mg of a measuring sample to the electrolytic aqueous solution.

(3) The electrolytic aqueous solution in which the measuring sample is suspended is subject to a dispersion treatment for 1 to 3 minutes with a supersonic disperser.

(4) Measure the number distribution for each particle diameter channel described below while the aperture is set to 100 μm for the measuring device mentioned above.

(5) Calculate the weight average particle diameter (D4) and the number average particle diameter (D1) of the toner from the obtained distribution. The whole range is a particle diameter of from 2.00 to not greater than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm.

The toner of the present invention is a toner manufactured by pulverization using a counter air pulverizer. Specific examples of suitable counter air pulverizers include PJM-I (manufactured by Nippon pneumatic MFG. Co., Ltd.), MICRON JET MILL® and COUNTER JET MILL® (manufactured by Hosokawa Micron Corporation), and CROSS JET® mill (manufactured by Kurimoto Ltd.).

By pulverizing the toner particles with a counter air pulverizer, the circularity and the smoothness of the surface of the toner particles are improved. When the thus obtained toner particles are used to cover isolated dots in the developing process, packing of the toner particles relative to each other is good with less voids. Thus the isolated dots on an image bearing member tend to be properly reproduced. In addition, the granularity of such toner particles is good, resulting in images having a good gradation.

When toner particles are not pulverized by a counter air pulverizer in the pulverization process, the surface property thereof is not greatly improved and the effect of the present invention may not be achieved sufficiently achieved.

The toner of the present invention can be mechanically pulverized prior to the counter air pulverization.

In addition, the toner of the present invention can be mechanically pulverized prior to the counter air pulverization until the toner particles have a weight average particle diameter and/or mode value particle diameter of from 5 to 15 μm.

A counter air pulverizer pulverizes toner particles in such that a site having an electrostatic property emerges on the surface of the pulverized toner when surface pulverization is performed and such a site tends to be removed from the pulverized toner particles, resulting in production of super fine toner particles having a particle diameter not greater than 2 μm with an extremely high electrostatic property. Therefore it is extremely difficult to remove such super fine toner particles in the following process of classifying fine toner particles.

Production of toner particles having too much excessive circularity and super fine toner particles can be restrained by mechanically pulverizing toner particles prior to pulverization by a counter air pulverizer until toner particles having a weight average particle diameter and/or a mode value particle diameter not greater than 15 μm are obtained.

Toner pulverization without prior mechanical pulverization leads to an increase of the amount of consumption energy in the process of pulverizing toner particles until the particle diameter are reduced to 4 to 7 μm. In addition, such toner particles have excessive circularity, and thus it is difficult to remove super fine toner particles adhered to an image bearing member. Further, a large amount of super fine toner particles having a particle diameter not greater than 2 μm is produced. When super fine toner particles having a particle diameter not greater than 2 μm occupy more than 30% of the total amount of the toner constituent pulverized by a counter air pulverizer, it is extremely difficult to remove such super fine toner particles in a dry classification process, and consequently it may be impossible to reduce the ratio of toner particles having a particle diameter of from 0.6 to 2.0 μm to not greater than 5% in the particle size distribution obtained after one-pass classification.

Although it is possible to eliminate such super fine toner particles having a particle diameter of from 0.6 to 2.0 μm by a wet method using, for example, a decanter centrifugal machine, such wet methods are not preferred in terms of productivity. In addition, in such a wet method, a surface active agent is used to disperse a toner in water and may affect the electrostatic property when the toner is not washed sufficiently. Therefore, a dry classification is preferred.

In the toner pulverization process mentioned above, toner particles are pulverized by a mechanical pulverizer prior to counter air pulverization until the mechanically pulverized toner particles have a particle diameter of from 5 to 15 μm, and preferably from 5 to 10 μm. Thus the surface property of toner particles can be improved while production of toner particles having grossly excessive circularity and super fine toner particles by using a counter air pulverizer, is reduced.

Specific examples of mechanical pulverizers include KRYPTRON® (manufactured by Kawasaki Heavy Industries, LTD.), TURBO MILL™ (manufactured by Turbo Kogyo Co., Ltd.), and ACM® pulverizer and innomizer® (both are manufactured by Hosokwa Micron Corporation). Each pulverizer can provide a desired particle diameter by adjusting the number of rotation of the pulverization rotor thereof.

The classification process for a toner in the present invention is a whirl air classification. The toner powder is classified into fine toner powder and coarse toner powder by centrifugalization in a classification room. The classification room is formed by a classification cover having a first conical form and a classification board having a second conical form underlying the classification cover. The toner powder is whirled at a high speed by air flown in through an air inlet in each of a plurality of louvers. The plurality of louvers are circularly arranged between the undersurface of the first conical form formed by the classification cover and the top surface of the second conical form formed by the classification board at an outer circumference of the classifying room. The coarse toner powder is discharged through a coarse toner powder discharging mouth formed around the classifying board. The fine toner powder is discharged from a fine toner powder discharging tube connected to a center of the classifying board.

It is possible to efficiently remove super fine toner particles having a particle diameter not greater than 2.0 μm by the whirl air classifier mentioned above. Specific examples of such whirl air classifiers include MICROSPIN (manufactured by Nippon pneumatic MFG. Co., Ltd.).

A specific example of the whirl air classifier mentioned above is a classifier illustrated in FIG. 2.

Figure 2:
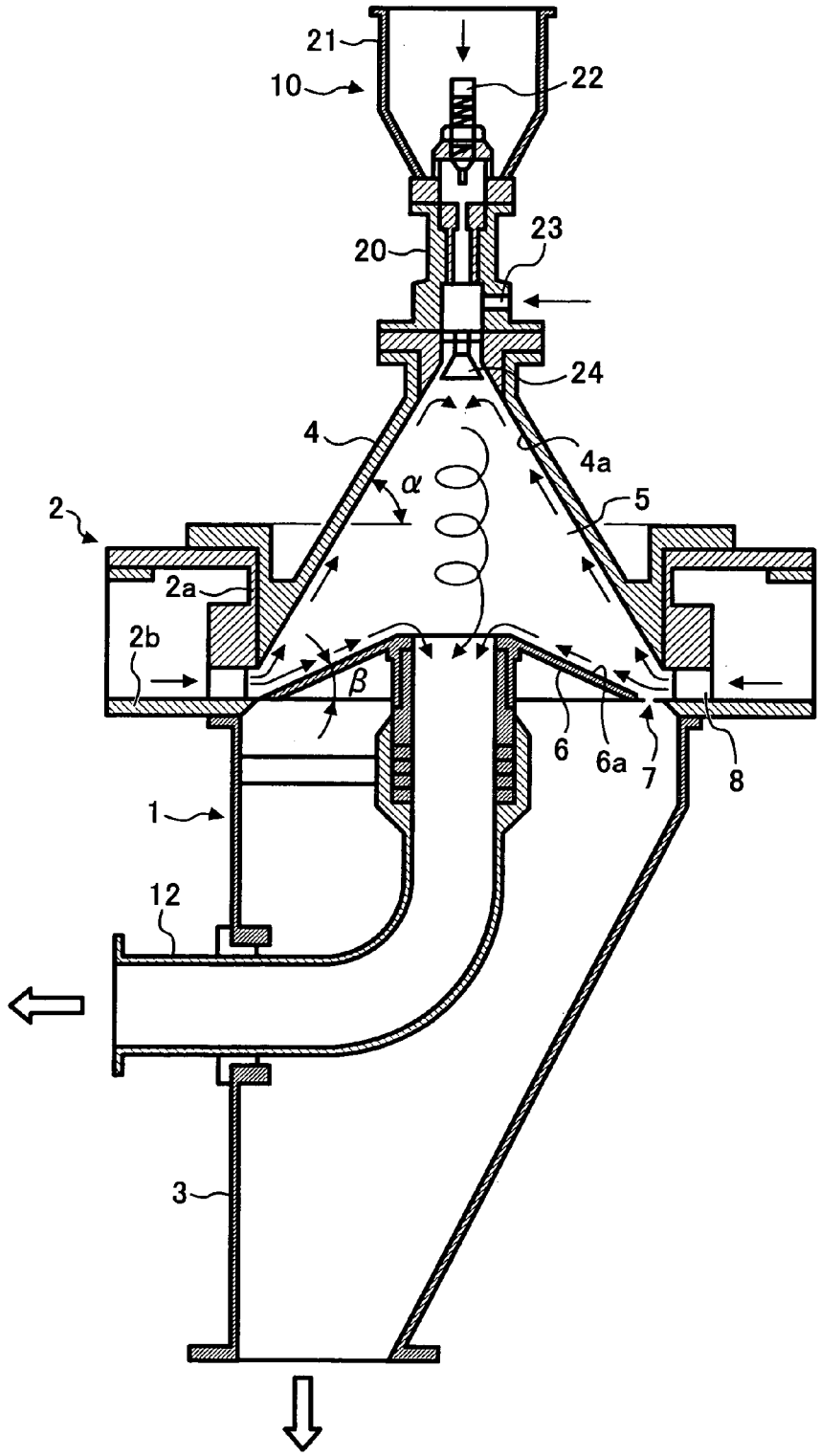
FIG. 2 is a diagram illustrating an embodiment of a classifier classifying the toner of the present invention.

The classifier is described with reference to the FIG. 2. As illustrated in FIG. 2, a casing 1 is formed of an upper casing 2 having a cylinder form and a lower casing 3 having a form with its cross section decreasing towards its bottom along the horizontal direction. A supplying device 10 is disposed on the upper side of a cover 4. The supplying device 10 comprises a powder supplying tube 20 connected to the central portion of the cover 4, a hopper 21 connected to the upper portion of the powder supplying tube 20 and an air spraying nozzle 22 disposed in the hopper 21. The air spraying nozzle 22 sprays compressed air into the powder supplying tube 20 to introduce powder in the hopper 21 into the powder supplying tube 20.

The cover 4 is detachably attached to the upper casing 2 with one or more fasteners, such as bolts. A classifying board 6 is provided below the cover 4 to form a classifying room 5 therebetween. A circular coarse powder discharge mouth 7 is circularly formed between the outer circumference of the classifying board 6 and the inner circumference of the upper casing 2.

The cover 4 and the classifying board 6 are extended upward to have a conical form. A slanting angle α formed between an under surface 4*a* of the cover 4 and the horizontal plane is larger than a slanting angle β formed between a top surface 6*a* of the classifying board 6 and the horizontal plane.

The upper casing 2 is divided into an upper ring 2*a* and a lower ring 2*b*. A plurality of louvers 8 are circularly disposed between the upper ring 2*a* and the lower ring 2*b* along the circumference direction of the classifying room 5 with a certain interval.

The louvers 8 can be arranged at any angle relative to the vertical axis thereof. A circulation path is formed in each adjacent louver 8. The circulation paths are configured to introduce a secondary air from the outside to the classifying room 5 toward the whirling direction of the powder whirling therein.

The bottom outer diameter of the under surface 4*a* of the cover 4 having a conical form is the same as the inner diameter of the upper casing 2 and is disposed at a substantially same level as the upper circumference of the louvers 8.

The powder supplying tube 20 includes an air spraying hole 23 from which compressed air is sprayed towards the outer circumference direction of the powder supplying tube 20. The compressed air functions to whirl solid-and-air fluid flowing downward in the powder supplying tube 20. The whirling solid-and-air fluid is supplied into the classifying room 5 along the outer circumference of a cone 24 provided at the opening mouth at the bottom end of the powder supplying tube 20.

A fine powder discharging tube 12 is connected to the center of the classifying board 6. The fine powder discharging tube 12 pierces through the lower casing 3.

In the air classifier according to the invention when powder is classified, the spraying nozzle 22 sprays powder and solid-and-air fluid on compressed air toward the outer circumference portion in the classifying room 5 in a state where suction power is imparted toward in the fine powder discharging tube 12.

When the solid-and-air fluid is sprayed into the classifying room 5, the solid-and-air fluid whirls therein. At this point, a secondary air is streamed into the classifying room 5 from the circulation paths of the louvers 8. The secondary air accelerates the speed of the powder whirling in the classifying room 5 and the powder is classified into fine powder and coarse powder by a centrifugal force.

The fine powder moves towards the center of the classifying room 5 and is suctioned to the fine powder discharging tube 12, and is discharged therefrom. The coarse powder moves towards the outer circumference portion in the classifying room 5, and is discharged to the casing 3 through the coarse powder discharging mouth 7.

To obtain pulverized matters, after preparatorily mixed raw materials are kneaded with a kneader (such as an extruder), the kneaded mixture is cooled and coarsely pulverized to have a size of about 1 mm.

In addition, the toner of the present invention has an appropriate average circularity, good transferability and good cleanability. Further, a filling ability for isolated dots is also improved.

Circularity of the toner can be adjusted by a rounding treatment, by changing the number of a classifying rotor, and the flowing amount of suction wind of a blower.

The average circularity of the toner is 0.92 and 0.97, and preferably from 0.94 to 0.96.

When the circularity of a toner is too small, the granularity thereof is extremely bad.

Also, for the toner of the present invention, fine powder produced in the pulverization and/or classification processes can be retrieved for reuse in kneading or fusing and kneading process and can be granulated again.

Inorganic fine powder such as silica fine powder and titan oxide fine powder can be externally added to the toner of the present invention to impart fluidity.

The toner of the present invention can form a two-component developer with known carriers. Specific examples of such known carriers include magnetic particles such as iron powder, ferrite powder, nickel powder and magnetite, and the magnetic particles the surface of which is coated by a fluorine containing resin, a vinyl containing resin, a silicone containing resin, etc., and magnetic particles dispersed resin particles in which magnetic particles are dispersed in a resin. The average particle diameter of such magnetic carriers is preferably from 30 to 75 μm.

The developer of the present invention is a two component developer comprising a carrier the surface of which is coated with a silicone resin containing a silane coupling resin agent. Since silicone resins have a low surface energy, the amount of toner spent in a developer can be reduced. Condensation reaction type silicone resins having a methyl group as a substitute group are particularly suitable. Since this type of resin has a dense structure, the amount of toner spent can be more reduced. When the amount of toner used is reduced, the toner and the carrier are frictionally charged quickly. As a result, the charge amount distribution of the toner is sharp and the quality of an image is improved.

Further, a carrier core material and a resin have good attachment properties by having a silane coupling agent in the resin coating the carrier core material. Therefore, even when such a developer is used for development for a long time, the resin coating layer does not detach from the carrier core material of the developer and thus the quality of images can be maintained for a long time.

The toner of the present invention can be used in known image forming methods.

Also the toner of the present invention can be used in a latent image forming apparatus including a latent image bearing member, a device to form a latent image on the latent image bearing member, a developing device to develop the latent image on the latent image bearing member with a toner to form a toner image, a transfer device to transfer the toner image to a transfer material and/or a cleaning device to clean the image bearing member after transferring images.

The process cartridge of the present invention uses the toner of the present invention and comprises an image bearing member, a developing device and at least one of a charging device and a cleaning device. Also the process cartridge can be detachably attachable to an image bearing member.

A schematic structure of an image forming apparatus including the process cartridge of the present invention is now described with reference to FIG. 3.

Figure 3:
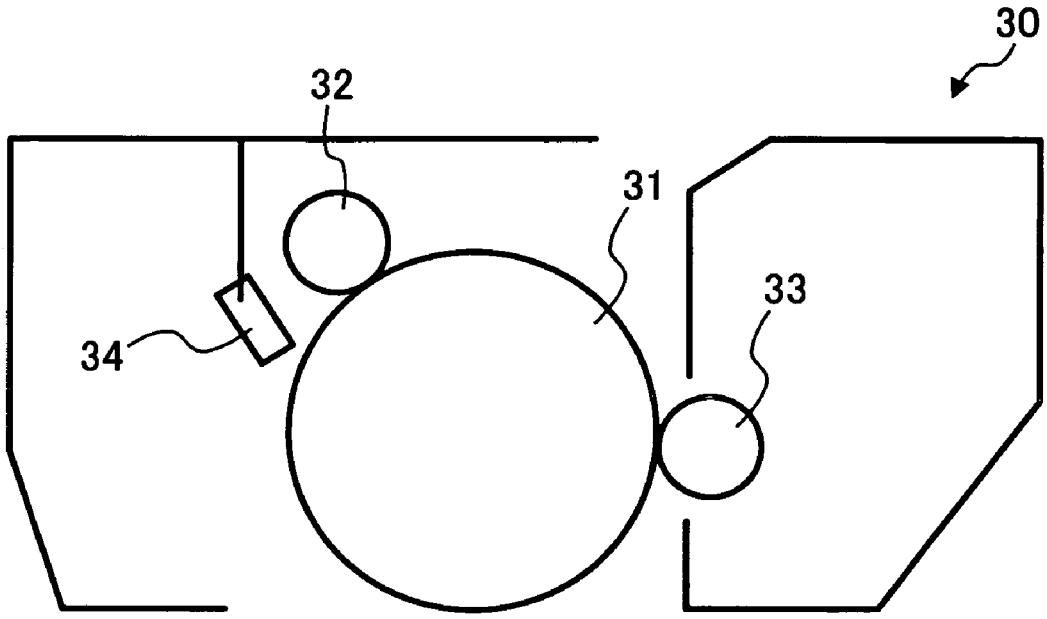
FIG. 3 is a schematic diagram illustrating an image forming apparatus containing an embodiment of the process cartridge of the present invention.

FIG. 3 shows a process cartridge 30, an image bearing member 31, a charging device 32, a developing device 33 and a cleaning device 34, respectively.

In the present invention, at least the developing device 33 and at least one of the other elements can be integrally combined as a process cartridge. This process cartridge is detachably attachable to an image forming apparatus of, for example, a photocopier and a printer.

Operation of an image forming apparatus including the process cartridge is as follows:

(1) The image bearing member is driven to rotate at a predetermined circumference speed;

(2) The surface of the image bearing member is uniformly negatively or positively charged to a predetermined potential in the rotation cycle;

(3) The image bearing member is irradiated by an image irradiation device with an image irradiation beam such by a slit irradiation or laser beam scanning irradiation;

(4) A latent electrostatic image is formed on the surface of the image bearing member;

(5) The latent electrostatic image is developed by a developing device with a toner to form a toner image;

(6) The toner image is accordingly transferred to a transfer material which is fed from a paper feeding portion to a portion sandwiched between the image bearing member and a transfer device while the transfer material is synchronized to the rotation of the image bearing member;

(7) After the toner image is transferred to a transfer material, the transfer material carrying the toner image is detached from the image bearing member and is transferred to an image fixing device;

(8) The image fixing device fixes the image on the transfer material;

(9) The transfer material is discharged outside the image forming apparatus as a copy;

(10) After transfer, toner remaining on the image bearing member is removed by a cleaning device; and

(11) The image bearing member is discharged for a next cycle.

The toner of the present invention can be manufactured by the method of the present invention, in which toner is preliminarily pulverized to have a weight average particle diameter not greater than 10 μm, and then pulverized with a counter air pulverizer.

The toner of the present invention can be efficiently manufactured by the toner manufacturing method of the present invention.

Granularity is one of the image quality evaluation criteria which is a physical amount representing image roughness as described in "Fine imaging and hard copy", herein incorporated by reference, (issued on Jan. 7, 1999 by Society of Photographic Science and Technology of Japan and The Imaging Society of Japan). For an image having a uniform density, a standard deviation is calculated for its image density or lightness distribution by scanning a minute opening in the image with a microdensitometer, etc. When a monochrome image is the case, granularity of a toner is calculated by assigning its standard deviation into the following mathematical formula (1) defined by Dooley, etc.

$$\text{GRANULARITY}=\exp(a\bar{L}+b)\int\sqrt{WS_L(f)}VTF(f)df \qquad \text{[Mathematical formula 1]}$$

wherein L represents average lightness, f represents spatial frequency (c/mm), $WS_L(f)$ represents lightness fluctuation power spectrum, VTF(f) represents spatial frequency characteristics of vision, and a and b represent coefficients.

Granularity is an objective amount, representing the level of non-uniformity of an image which should be uniform.

Since granularity is a standard deviation of an image density or lightness distribution, a small value is preferred, and a value not greater than 1.0 is required for graphical images.

Next compositions of the toner of the present invention are described.

Known binder resins and colorants can be used for the toner of the present invention.

Vinyl resins, polyester resins or polyol resins can be used. Among them, polyester resins or polyol resins are preferred.

Specific examples of such vinyl resins include styrenes such as polystyrenes, poly-p-chlorostyrenes and polyvinyl toluenes and monopolymer of their derivative substitutions, styrene containing copolymers such as styrene-p-chlorostyrene copolymers, styrene-propylene copolymers, styrene vinyl toluene copolymers, styrene vinyl naphthalene copolymers, styrene methyl acrylate copolymers, styrene ethyl acrylate copolymers, styrene butyl acrylate copolymers, styrene octyl acrylate copolymers, styrene methyl methacrylate copolymers, styrene ethyl methacrylate copolymers, styrene butyl methacrylate copolymers, styrene-α-methyl chloromethacrylate copolymers, styrene acrylic nitrile copolymers, styrene-vinyl methyl ether copolymers, styrene-vinyl ethyl ether copolymers, styrene-vinyl methyl ketone copolymers, styrene-butadiene copolymers, styrene isoprene copolymers, styrene acrylic nitrile indene copolymers, styrene maleic acid copolymers and styrene maleic ester polymers, polymethyl methacrylates, polybutyl methacrylates, polyvinyl chlorides and polyvinyl acetates.

Such polyester resins are formed by a dihydric alcohol shown below in group A, a salt of a dibasic acid shown below in group B and optionally a trihydric or higher alcohol or a carboxylic acid shown below in group C.

Group A: ethylene glycols, triethylene glycols, 1,2-propylene glycols, 1,3-propylene glycols, 1,4-butan diols, neopentyl glycols, 1,4-butene diols, 1,4-bis (hydroxymethyl) cyclohexane, bisphenol A, hydrogen added bisphenol A, polyoxyethylenified bisphenol A, polyoxypropylene (2,2)-2,2'-bis (4-hydroxyphenyl) propane, polyoxypropylene (3,3) 2,2-bis (4-hydroxylphenyl) propane, polyoxyethylene (2,0)-2,2-bis (4-hydroxylpheny) propane, polyoxypropylene (2,0)-2,2'-bis (4-hydroxylphenyl) propane, etc.

Group B: maleic acid, fumaric acid, methaconic acid, citraconic acid, itakonic acid, glutaconic acid, phtalic acid, isophtalic acid, terephtalic acid, cyclohexane dicarboxylic acid, succinic acid, adipic acid, sebacic acid, malonic acid, linoleic acid, their anhydrates and their esters with a lower alcohol.

Group C: trivalent or higher alcohols such as glycerin, trimethylolpropane and pentaerythritol and tribasic or higher carboxylic acid such as trimellitic acid and pyromellitic acid.

Specific examples of polyols include a resultant of an epoxy resin, an alkylene oxide adduct of a divalent phenol or their glycidyl ether, a compound containing one active hydrogen atom reacting with an epoxy group and a compound containing at least two active hydrogen atoms reacting with an epoxy group.

The following resins can be also mixed if desired: epoxy resins, polyamide resins, urethane resins, phenol resins, butyral resins, rosins, modified rosins and terpene resins.

Specific examples of such epoxy resins include polycondensation compounds of a bisphenol such as bisphenol A and bisphenol F and epichlorohydrine.

Specific examples of colorants for the toner of the present invention are as follows:

Black pigments: azine containing colorants such as carbon black, oil furnace black, channel black, lamp black, acetylene black, aniline black, metal salt azo colorants, metal oxides and complex metal oxides;

Yellow pigments: cadmium Yellow, mineral fast yellow, nickel titan yellow, navels yellow, naphthol yellow S, hansa yellow G, hansa yellow 10G, benzidine yellow GR, quinoline yellow lake, permanent yellow NCG and tartrazine lake;

Orange pigments: molybdenum orange, permanent orange GTR, pyrazolone orange, vulcan orange, indanthrene brilliant orange RK, benzidine orange G and indanthrene brilliant orange GK.

Red pigments: colcothar, cadmium red, permanent red 4R, lithol red, pyrazolone red, watching red calcium salt, lake red D, brilliant carmine 6B, eosin lake, rhodamine lake B, alizarine lake and brilliant carmine 3B;

Violet pigments: fast violet B and methyl violet lake;

Blue pigments: cobalt blue, alkali blue, victoria blue lake, phthalocyanine blue, metal-free phthalocyanine blue, a chlorinate of phthalocyanine blue portion, fast sky blue and indanthrene blue BC; and Green pigments: chrome green, a chrome oxide, pigment green B and malachite green lake.

These can be used alone or in combination.

The amount of such a colorant for use in the toner is typically 0.1 to 50 parts by weight per 100 parts by weight of a binder resin.

To impart releasability to a toner, a synthesized wax such as low molecular weight polyethylene and polypropylene, a natural wax such as carnauba wax, rice wax and lanoline, and known release agents can be used.

The toner of the present invention can contain known charge controlling agents such as metal salts or metal complex of a salicylic acid.

The toner of the present invention can be a magnetic toner. Specific examples of known magnetic materials include iron oxides such as magnetite and hematite.

Further, fluidity can be imparted to the toner of the present invention by externally adding inorganic fine powder such as titan oxide fine powder thereto.

When toner fluidity is improved, friction charging between toner particles and carrier particles can be quickly performed. Therefore, charge amount distribution becomes sharp, resulting in improvement of the quality of images.

Having generally described this invention, further understanding can be obtained by reference to the following specific examples, which are provided herein for the purpose of illustration only and are not intended to be limiting. In the descriptions in the following examples, the numbers represent weight ratios in parts, unless otherwise specified.

EXAMPLES

The present invention is now described with reference to examples.

However, these examples are part of preferred embodiments of the present invention and the technological scope of the present invention is not limited thereto.

Example 1

The following materials were mixed with a mixer:

| | |
|---|---|
| Polyol resin | 100.0 parts |
| Quinacridone magenta pigment (C.I.Pigment Red122) | 6 parts |
| Zinc salt of salicylic acid (charge controlling agent) | 2 parts |

The mixture was fused and kneaded with a two roll followed by mechanical pulverization to obtain particles having a weight average particle diameter of 14.8 μm and a mode value particle diameter of 14.1 μm. The obtained particles were pulverized by a fluidized bed counter air and fine powder produced was removed by a microspin classifier.

Further, the following was added to the classified mother toner particles obtained.

| | |
|---|---|
| Hydrophobic silica | 0.8 parts |
| Titan oxide | 0.4 parts |

The resultant was mixed with a mixer and agglomerates were removed by a supersonic sieve. The characteristics of the obtained toner are as follows:

| | |
|---|---|
| Particles having a circle equivalent particle diameter of from 0.6 to 2.0 μm | 4.8% by quantity |
| Weight average particle diameter (D4) | 5.3 μm |
| Number average particle diameter (D1) | 4.1 μm |
| Fine particle having a particle diameter from 3.17 to 4.00 μm | 35% by quantity |
| Fine particle having a particle diameter from 4.00 to 5.04 μm | 25% by quantity |
| Coarse particle having a particle diameter not less than 12.7 μm | 0.3% by weight |
| The ratio (D4/D1) of the weight average particle diameter (D4) to the number average particle diameter (D1) | 1.25 |
| Circularity | 0.96 |

The toner characteristics are shown in Table 1.

A carrier was obtained as follows:

Carbon black was dispersed in a silicone resin liquid by a homomixer to obtain a coating liquid:

| | |
|---|---|
| Silicone resin liquid | 10.0 parts by weight |
| Carbon black | 0.7 parts by weight |

The coating liquid was sprayed to coat the surface of 60.0 parts by weight of a magnetite core material using a fluid bed coating device forming a fluid layer by centrifugal movement caused by a rotation disc and flowage by air stream. The resultant was subject to a resin curing treatment by an electric furnace, followed by removing agglomerates by a vibrating sieve. The carrier was thus obtained.

Further, the toner and the carrier were mixed by a turbular mixer and a developer having a toner having a concentration of 3.5% was obtained.

An imaging test for this developer was performed for 200,000 impressions with an image forming apparatus remodeled based on IPSIO CX8200 manufactured by Ricoh. Co., Ltd. to have an output ability of 35 sheets per minute.

The transfer materials used were plain paper. The amount of the toner on a plain paper was controlled to be within the range of from 0.63 to 0.68 g/cm$^2$. A silicon impregnated rubber roller was used as an elastic roller to fix the toner onto the transfer material upon application of heat and pressure. The rubber roller had a thickness of 0.3 mm and a TEFLON® layer having a thickness of 30 μm as the outermost layer.

The evaluation results of 100th image and 200,000th image for the continuous image output operation are shown in Table 2.

Example 2

The toner of Example 2 was manufactured in the same manner as in Example 1 except that the raw materials were mechanically pulverized until particles having a weight average particle diameter of 7.8 μm and a mode value particle diameter of 7.1 μm were obtained, followed by pulverization by a fluidized bed counter air and the obtained particles were classified by a wheel type mechanical classifier twice to remove fine powder produced.

The characteristics of the toner are shown in Table 1.

Further, a developer was manufactured by using the toner of Example 2 and the carrier of Example 1. The developer had a toner condensation of 3.5%. The evaluation results of the developer for the same imaging test as Example 1 are shown in Table 2.

Example 3

The toner of Example 3 was manufactured in the same manner as in Example 1 except that the fine powder produced at classification was reused in the kneading process, and the resultant was mechanically pulverized to obtain toner particles having a weight average particle diameter of 8.9 μm and a mode value particle diameter of 8.4 μm followed by pulverization by a fluidized bed counter air, and the obtained particles were classified by a microspin classifier.

The characteristics of the toner are shown in Table 1.

Further, a developer was manufactured by using the toner of Example 3 and the carrier of Example 1. The developer had a toner condensation of 3.5%. The evaluation results of the developer for the same imaging test as Example 1 are shown in Table 2.

Example 4

The toner of Example 4 was manufactured in the same manner as in Example 3 except that the microspin classification was performed twice.

The characteristics of the toner are shown in Table 1.

Further, a developer was manufactured by using the toner of Example 4 and the carrier of Example 3. The developer had a toner condensation of 3.5%. The evaluation results of the developer for the same imaging test as Example 3 are shown in Table 2.

Example 5

The toner of Example 4 was manufactured in the same manner as in Example 3 except that the microspin classification was performed four times.

The characteristics of the toner are shown in Table 1.

Further, a developer was manufactured by using the toner of Example 5 and the carrier of Example 3. The developer had a toner condensation of 3.5%. The evaluation results of the developer for the same imaging test as Example 3 are shown in Table 2.

Example 6

The raw materials of Example 1 were mixed by a mixer and kneaded by a two roll as in Example 1. The resultant was pulverized by a fluid bed counter air pulverizer. The ratio of the pulverized substance having a circle equivalent particle diameter of from 0.6 to 2.0 μm was 32.4% when measured by a flow particle image analyzer.

The pulverized substance was classified by a wheel type classifier twice to remove fine powder. The ratio of the particle having a circle equivalent particle diameter of from 0.6 to 2.0 μm was 19.4%.

Further, a surface active agent was dropped to the obtained powder particle under a supersonic washer. Then distilled water was added to the resultant to sufficiently disperse the resultant in water. The dispersion liquid obtained was set in a decanter type centrifugal machine to remove super fine powder. The resultant was sufficiently washed with distilled water and dried. Thus mother toner particles were obtained.

The following was added to the mother toner particles obtained as in Example 1.

| | |
|---|---|
| Hydrophobic silica | 0.8 parts |
| Titan oxide | 0.4 parts |

The resultant was mixed with a mixer and agglomerate was removed by a supersonic sieve. The characteristics of the obtained toner are as follows:

| | |
|---|---|
| Particles having a circle equivalent particle diameter of from 0.6 to 2.0 μm | 3.7% by quantity |
| Weight average particle diameter (D4) | 5.2 μm |
| Number average particle diameter (D1) | 4.2 μm |
| Fine particle having a particle diameter from 3.17 to 4.00 μm | 32% by quantity |
| Fine particle having a particle diameter from 4.00 to 5.04 μm | 24% by quantity |
| Coarse particle having a particle diameter not less than 12.7 μm | 0.4% by weight |
| The ratio (D4/D1) of the weight average particle diameter (D4) to the number average particle diameter (D1) | 1.24 |
| Circularity | 0.97 |

The toner characteristics are shown in Table 1.

Further, a developer was manufactured by using the toner of Example 6 and the carrier of Example 1. The developer had a toner condensation of 3.5%. The evaluation results of the developer for the same imaging test as Example 1 are shown in Table 2.

Comparative Example 1

The toner of Comparative Example 1 was manufactured in the same manner as in Example 2 except that the number of rotor rotation of the mechanical pulverizer and the rotor circumference speed and the amount of blowing air flow of the wheel type classifier were changed.

The characteristics of the obtained toner are as follows:

| | |
|---|---|
| Particles having a circle equivalent particle diameter of from 0.6 to 2.0 μm | 4.9% by quantity |
| Weight average particle diameter (D4) | 6.6 μm |
| Number average particle diameter (D1) | 5.2 μm |
| Fine particle having a particle diameter from 3.17 to 4.00 μm | 15% by quantity |
| Fine particle having a particle diameter from 4.00 to 5.04 μm | 23% by quantity |
| Coarse particle having a particle diameter not less than 12.7 μm | 0.3% by weight |

The toner characteristics are shown in Table 1.

Further, a developer was manufactured by using the toner of Comparative Example 1 and the carrier of Example 2. The developer had a toner condensation of 3.5%. The evaluation results of the developer for the same imaging test as Example 2 are shown in Table 2.

Comparative Example 2

The toner of Comparative Example 2 was manufactured in the same manner as in Example 2 except that the number of rotor rotation of the mechanical pulverizer and the rotor circumference speed and the amount of blowing air flow of the wheel type classifier were changed.

The characteristics of the obtained toner are as follows:

| | |
|---|---|
| Particles having a circle equivalent particle diameter of from 0.6 to 2.0 μm | 4.7% by quantity |
| Weight average particle diameter (D4) | 5.3 μm |
| Number average particle diameter (D1) | 4.3 μm |
| Fine particle having a particle diameter from 3.17 to 4.00 μm | 45% by quantity |
| Fine particle having a particle diameter from 4.00 to 5.04 μm | 50% by quantity |
| Coarse particle having a particle diameter not less than 12.7 μm | 0.2% by weight |

The toner characteristics are shown in Table 1.

Further, a developer was manufactured by using the toner of Comparative Example 2 and the carrier of Example 2. The developer had a toner condensation of 3.5%. The evaluation results of the developer for the same imaging test as Example 2 are shown in Table 2.

Comparative Example 3

The toner of Comparative Example 3 was manufactured in the same manner as in Example 2 except that the number of rotor rotation of the mechanical pulverizer and the rotor circumference speed and the amount of blowing air flow of the wheel type classifier were changed.

The characteristics of the obtained toner are as follows:

| | |
|---|---|
| Particles having a circle equivalent particle diameter of from 0.6 to 2.0 μm | 4.6% by quantity |
| Weight average particle diameter (D4) | 5.8 μm |
| Number average particle diameter (D1) | 4.6 μm |
| Fine particle having a particle diameter from 3.17 to 4.00 μm | 8% by quantity |
| Fine particle having a particle diameter from 4.00 to 5.04 μm | 17% by quantity |
| Coarse particle having a particle diameter not less than 12.7 μm | 0.2% by weight |

The toner characteristics are shown in Table 1.

Further, a developer was manufactured by using the toner of Comparative Example 3 and the carrier of Example 2. The developer had a toner condensation of 3.5%. The evaluation results of the developer for the same imaging test as Example 2 are shown in Table 2.

Comparative Example 4

The toner of Comparative Example 4 was manufactured in the same manner as in Example 2 except that the number of rotor rotation of the mechanical pulverizer and the rotor circumference speed and the amount of blowing air flow of the wheel type classifier were changed.

The characteristics of the obtained toner are as follows:

| | |
|---|---|
| Particles having a circle equivalent particle diameter of from 0.6 to 2.0 μm | 4.8% by quantity |
| Weight average particle diameter (D4) | 5.7 μm |
| Number average particle diameter (D1) | 4.5 μm |
| Fine particle having a particle diameter from 3.17 to 4.00 μm | 28% by quantity |
| Fine particle having a particle diameter from 4.00 to 5.04 μm | 23% by quantity |
| Coarse particle having a particle diameter not less than 12.7 μm | 1.3% by weight |

The toner characteristics are shown in Table 1.

Further, a developer was manufactured by using the toner of Comparative Example 4 and the carrier of Example 2. The developer had a toner condensation of 3.5%. The evaluation results of the developer for the same imaging test as Example 2 are shown in Table 2.

Comparative Example 5

The toner of Comparative Example 5 was manufactured in the same manner as in Example 2 except that the number of rotor rotation of the mechanical pulverizer and the rotor circumference speed and the amount of blowing air flow of the wheel type classifier were changed.

The characteristics of the obtained toner are as follows:

| | |
|---|---|
| Particles having a circle equivalent particle diameter of from 0.6 to 2.0 μm | 4.9% by quantity |
| Weight average particle diameter (D4) | 5.0 μm |
| Number average particle diameter (D1) | 3.8 μm |
| Fine particle having a particle diameter from 3.17 to 4.00 μm | 38% by quantity |
| Fine particle having a particle diameter from 4.00 to 5.04 μm | 35% by quantity |
| Coarse particle having a particle diameter not less than 12.7 μm | 0.2% by weight |
| The ratio (D4/D1) of the weight average particle diameter (D4) to the number average particle diameter (D1) | 1.32 |

The toner characteristics are shown in Table 1.

Further, a developer was manufactured by using the toner of Comparative Example 5 and the carrier of Example 2. The developer had a toner condensation of 3.5%. The evaluation results of the developer for the same imaging test as Example 2 are shown in Table 2.

Comparative Example 6

The toner of Comparative Example 6 was manufactured in the same manner as in Example 2 except that the pulverization process was performed only by mechanical pulverization without counter air pulverization.

The characteristics of the obtained toner are as follows:

| | |
|---|---|
| Particles having a circle equivalent particle diameter of from 0.6 to 2.0 μm | 4.6% by quantity |
| Weight average particle diameter (D4) | 5.4 μm |
| Number average particle diameter (D1) | 4.3 μm |
| Fine particle having a particle diameter from 3.17 to 4.00 μm | 38% by quantity |
| Fine particle having a particle diameter from 4.00 to 5.04 μm | 28% by quantity |
| Coarse particle having a particle diameter not less than 12.7 μm | 0.1% by weight |

The toner characteristics are shown in Table 1.

Further, a developer was manufactured by using the toner of Comparative Example 6 and the carrier of Example 2. The developer had a toner condensation of 3.5%. The evaluation results of the developer for the same imaging test as Example 2 are shown in Table 2.

Comparative Example 7

The toner of Comparative Example 7 was manufactured in the same manner as in Example 2 except that the pulverized substance mechanically pulverized had a weight average particle diameter of 22 μm. The obtained toner characteristics are shown in Table 1.

Further, a developer was manufactured by using the toner of Comparative Example 7 and the carrier of Example 2. The developer had a toner condensation of 3.5%. The evaluation results of the developer for the same imaging test as Example 2 are shown in Table 2.

Comparative Example 8

The toner of Comparative Example 8 was manufactured in the same manner as in Example 2 except that the mechanically pulverized substance had a weight average particle diameter of 43 μm. The obtained toner characteristics are shown in Table 1.

Further, a developer was manufactured by using the toner of Comparative Example 8 and the carrier of Example 2. The developer had a toner condensation of 3.5%. The evaluation results of the developer for the same imaging test as Example 2 are shown in Table 2.

Comparative Example 9

The toner of Comparative Example 9 was manufactured in the same manner as in Example 6 except that super fine powder was not removed by a decanter type centrifugal machine. The obtained toner characteristics are shown in Table 1.

Further, a developer was manufactured by using the toner of Comparative Example 9 and the carrier of Example 2. The developer had a toner condensation of 3.5%. The evaluation results of the developer for the same imaging test as Example 2 are shown in Table 2.

Comparative Example 10

The toner of Comparative Example 10 was manufactured in the same manner as in Example 2 except that the pulverization process was performed only by a collision board pulverizer. The obtained toner characteristics are shown in Table 1.

Further, a developer was manufactured by using the toner of Comparative Example 10 and the carrier of Example 2. The developer had a toner condensation of 3.5%. The evaluation results of the developer for the same imaging test as Example 2 are shown in Table 2.

The imaging test method and the evaluation criteria are as follows:

(1) Image density is determined by measuring reflection density of a black solid portion of a copy image with an X-Rite reflection densitometer.

(2) Granularity is calculated by assigning an image density value measured with a scanner HEIDELBERG Nexscan F410 into Dooley's definition formula.

(3) Toner development at non-image portion, i.e., background development, is observed. The criteria are as follows:

G: when there is no such background toner development:

Y: when there is background toner development with no practical problem; and

R: when there is background toner development causing a practical problem.

(4) The definition level is determined by how many black lines can be distinguished when a manuscript carrying black fine lines in 1 mm drawn on a white sheet width with a same interval is copied.

TABLE 1

| | Super fine powder having a particle diameter of from 0.6 to 2.0 μm (% by quantity) | Weight average particle diameter (μm) (D4) | Number average particle diameter (μm) (D1) | Ratio of toner particles having a particle diameter of from 3.17 to 4.00 μm (% by quantity) | Ratio of toner particles having a particle diameter of from 4.00 to 5.04 μm (% by quantity) | Ratio of toner particles having a particle diameter not less than 12.7 μm (% by weight) | Ratio (D4/D1) of Weight average particle diameter (D4) to Number average particle diameter (D1) | Circularity |
|---|---|---|---|---|---|---|---|---|
| Example 1 | 4.8 | 5.3 | 4.1 | 35.0 | 25.0 | 0.3 | 1.29 | 0.96 |
| Example 2 | 3.8 | 5.4 | 4.8 | 31.0 | 27.0 | 0.3 | 1.13 | 0.95 |
| Example 3 | 2.5 | 5.4 | 4.7 | 34.0 | 27.0 | 0.2 | 1.15 | 0.95 |
| Example 4 | 0.1 | 5.7 | 4.8 | 35.0 | 28.0 | 0.2 | 1.19 | 0.95 |
| Example 5 | 0.0 | 5.6 | 4.9 | 34.0 | 27.0 | 0.2 | 1.14 | 0.95 |
| Example 6 | 3.7 | 5.2 | 4.2 | 32.0 | 24.0 | 0.4 | 1.24 | 0.97 |
| Comparative Example 1 | 4.9 | 6.6 | 5.2 | 15.0 | 23.0 | 0.3 | 1.27 | 0.95 |
| Comparative Example 2 | 4.7 | 5.3 | 4.3 | 45.0 | 50.0 | 0.2 | 1.23 | 0.95 |
| Comparative Example 3 | 4.6 | 5.8 | 4.6 | 8.0 | 17.0 | 0.2 | 1.26 | 0.95 |
| Comparative Example 4 | 4.8 | 5.7 | 4.5 | 28.0 | 23.0 | 1.3 | 1.27 | 0.95 |
| Comparative Example 5 | 4.9 | 5.0 | 3.8 | 38.0 | 35.0 | 0.2 | 1.32 | 0.95 |
| Comparative Example 6 | 4.6 | 5.4 | 4.3 | 37 | 28 | 0.1 | 1.26 | 0.94 |

TABLE 1-continued

| | Super fine powder having a particle diameter of from 0.6 to 2.0 μm (% by quantity) | Weight average particle diameter (μm) (D4) | Number average particle diameter (μm) (D1) | Ratio of toner particles having a particle diameter of from 3.17 to 4.00 μm (% by quantity) | Ratio of toner particles having a particle diameter of from 4.00 to 5.04 μm (% by quantity) | Ratio of toner particles having a particle diameter not less than 12.7 μm (% by weight) | Ratio (D4/D1) of Weight average particle diameter (D4) to Number average particle diameter (D1) | Circularity |
|---|---|---|---|---|---|---|---|---|
| Comparative Example 7 | 7.6 | 5.3 | 4.3 | 35 | 26 | 0.2 | 1.23 | 0.95 |
| Comparative Example 8 | 10.7 | 5.1 | 4.2 | 33 | 25 | 0.3 | 1.24 | 0.94 |
| Comparative Example 9 | 19.4 | 5.1 | 4.0 | 35.0 | 30.0 | 0.4 | 1.28 | 0.97 |
| Comparative Example 10 | 3.4 | 5.8 | 4.7 | 38 | 32 | 0.1 | 1.23 | 0.91 |

TABLE 2

| | The order of images | Image density | Granularity | Background development | Definition level | Impression of images |
|---|---|---|---|---|---|---|
| Example 1 | 100th | 1.50 | 0.2 | G | 7.2 | Excellent |
| | 200,00th | 1.45 | 0.2 | G | 7.2 | Excellent |
| Example 2 | 100th | 1.50 | 0.2 | G | 7.1 | Excellent |
| | 200,00th | 1.46 | 0.3 | G | 7.1 | Excellent |
| Example 3 | 100th | 1.50 | 0.2 | G | 7.1 | Excellent |
| | 200,00th | 1.46 | 0.3 | G | 7.1 | Excellent |
| Example 4 | 100th | 1.50 | 0.2 | G | 7.2 | Excellent |
| | 200,00th | 1.49 | 0.2 | G | 7.2 | Excellent |
| Example 5 | 100th | 1.50 | 0.2 | G | 7.2 | Excellent |
| | 200,00th | 1.48 | 0.2 | G | 7.2 | Excellent |
| Example 6 | 100th | 1.50 | 0.2 | G | 7.2 | Excellent |
| | 200,00th | 1.45 | 0.3 | G | 7.2 | Good |
| Comparative Example 1 | 100th | 1.49 | 0.5 | G | 6.5 | Image having non-uniform density from a start and with insufficient definition |
| | 200,00th | 1.45 | 0.6 | G | 5.1 | |
| Comparative Example 2 | 100th | 1.47 | 0.3 | G | 6.6 | Image quality already deteriorates at 200,000th image. |
| | 200,00th | 1.35 | 0.5 | Y | 6.5 | |
| Comparative Example 3 | 100th | 1.47 | 0.5 | G | 6.1 | Image having non-uniform density from a start and with insufficient definition |
| | 200,00th | 1.41 | 0.6 | G | 5.5 | |
| Comparative Example 4 | 100th | 1.47 | 0.5 | G | 6.9 | Image having non-uniform density from a start |
| | 200,00th | 1.44 | 0.5 | G | 6.5 | |
| Comparative Example 5 | 100th | 1.47 | 0.5 | G | 6.7 | Image having non-uniform density from a start |
| | 200,00th | 1.45 | 0.5 | G | 6.7 | |
| Comparative Example 6 | 100th | 1.47 | 0.5 | G | 6.5 | Image having non-uniform density from a start |
| | 200,00th | 1.44 | 0.5 | G | 6.7 | |
| Comparative Example 7 | 100th | 1.47 | 0.5 | G | 6.7 | Image having non-uniform density from a start and further deterioration at 200,000th image |
| | 200,00th | 1.35 | 0.6 | Y | 6.6 | |
| Comparative Example 8 | 100th | 1.47 | 0.5 | G | 6.8 | Image having non-uniform density from a start and further deterioration at 200,000th image |
| | 200,00th | 1.36 | 0.6 | Y | 6.3 | |
| Comparative Example 9 | 100th | 1.47 | 0.5 | G | 6.5 | Image having non-uniform density from a start and further deterioration at 200,000th image |
| | 200,00th | 1.35 | 0.6 | Y | 6.0 | |

TABLE 2-continued

| | The order of images | Image density | Granularity | Background development | Definition level | Impression of images |
|---|---|---|---|---|---|---|
| Comparative Example 10 | 100th | 1.47 | 0.7 | G | 6.4 | Image having extremely non-uniform density from a start |
| | 200,00th | 1.32 | 0.7 | Y | 6.1 | |

As seen in Table 2, the toner of the present invention has a good granularity and can be used to obtain images with uniform density. In addition, image density does not deteriorate for continuous high speed image outputs without the occurrence of background development.

This document claims priority and contains subject matter related to Japanese Patent Applications Nos. 2003-415342 and 2004-348918, filed on Dec. 12, 2003 and Dec. 1, 2004, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles comprising:

a binder resin; and a colorant, wherein the toner particles have a weight average particle diameter of from 4 to 7 μm and a circle equivalent diameter of from 0.6 to 2.0 μm in an amount not greater than 5% by quantity, a particle diameter of from 3.17 to 4.00 μm in an amount of from 10 to 40% by quantity, a particle diameter of from 4.00 to 5.04 μm in an amount of from 20 to 40% by quantity, and a diameter not less than 12.7 μm in an amount of from 0 to 1.0% by weight, and wherein the toner particles satisfy the following relationship:

$$1.04 \leqq D4/D1 \leqq 1.30,$$

wherein D4 represents the weight average particle diameter and D1 represents a number average particle diameter of the toner particles.

2. The toner according to claim 1, wherein an average circularity of toner particles having a circle equivalent diameter not less than 0.60 μm and less than 159.21 μm is from 0.92 to 0.97.

3. The toner according to claim 1, further comprising:

an external additive comprising at least one of silica and titanium oxide.

4. The toner according to claim 1, wherein the toner is prepared by a method comprising:

mixing the binder resin and the colorant to obtain a toner composition mixture;

kneading the toner composition mixture;

pulverizing the kneaded toner composition mixture with a counter air pulverizer to obtain a toner powder; and classifying the toner powder to obtain the toner.

5. The toner according to claim 4, wherein classifying comprises:

supplying the toner powder into a classification room formed by a classification cover having a first conical form and a classification board having a second conical form disposed under the classification cover; and supplying air through an air inlet formed in each of a plurality of louvers circularly arranged between an undersurface of the first conical form of the classification cover and a top surface of the second conical form of the classification board at an outer circumference of the classifying room to whirl the toner powder and to discharge a coarse toner powder through a coarse toner powder discharging mouth formed around the classifying board and to discharge a fine toner powder from a fine toner powder discharging tube connected to a center of the classifying board using a centrifugal force.

6. The toner according to claim 4, wherein fine toner powder produced in the pulverization or the classification is reused as the toner composition mixture in the kneading step.

7. The toner according to claim 4, wherein the method further comprises mechanically pulverizing the toner composition mixture prior to the counter air pulverization to obtain a toner powder.

8. The toner according to claim 7, wherein the toner powder obtained at the mechanical pulverization has at least one of a weight average particle diameter and a mode particle diameter in the range of from 5 to 15 μm.

9. A developer, comprising:

a toner comprising:

toner particles comprising:

a binder resin; and a colorant, wherein the toner has a weight average particle diameter of from 4 to 7 μm and comprises toner particles having a circle equivalent diameter of from 0.6 to 2.0 μm in an amount not greater than 5% by quantity, toner particles having a particle diameter of from 3.17 to 4.00 μm in an amount of from 10 to 40% by quantity, toner particles having a diameter of from 4.00 to 5.04 μm in an amount of from 20 to 40% by quantity, and toner particles having a diameter not less than 12.7 μm in an amount of from 0 to 1.0% by weight, and wherein the toner satisfies the following relationship:

$$1.04 \leqq D4/D1 \leqq 1.30,$$

wherein D4 represents the weight average particle diameter and D1 represents a number average particle diameter of the toner; and a carrier, comprising a surface coated with a silicone resin including a silane coupling agent.

10. An image forming method, comprising:

forming a latent image on a latent image bearing member;

developing the latent image with a developer to form a toner image on the latent image bearing member, the developer comprising:

a toner comprising:

toner particles comprising:

a binder resin; and a colorant, wherein the toner has a weight average particle diameter of from 4 to 7 μm and comprises toner particles having a circle equivalent diameter of from 0.6 to 2.0 μm in an amount not greater than 5% by quantity, toner particles having a particle diameter of from 3.17 to 4.00 μm in an amount of from 10 to 40% by quantity, toner particles having a diameter of from 4.00 to 5.04 μm in an amount of from 20 to 40% by quantity, and toner particles having a diameter not less than 12.7 μm in an amount of from 0 to 1.0% by weight, and wherein the toner satisfies the following relationship:

$$1.04 \leqq D4/D1 \leqq 1.30,$$

wherein D4 and D1 represent the weight average particle diameter and a number average particle diameter of the toner, respectively; and a carrier;

transferring the toner image on the latent image bearing member to a transfer material; and cleaning the latent image bearing member.

11. An image forming apparatus, comprising:

a latent image bearing member configured to bear a latent image;

a developing device configured to develop to form a toner image on the latent image bearing member, the developer comprising:

a toner comprising:

toner particles comprising:

a binder resin; and a colorant, wherein the toner has a weight average particle diameter of from 4 to 7 μm and comprises toner particles having a circle equivalent diameter of from 0.6 to 2.0 μm in an amount not greater than 5% by quantity, toner particles having a particle diameter of from 3.17 to 4.00 μm in an amount of from 10 to 40% by quantity, toner particles having a diameter of from 4.00 to 5.04 μm in an amount of from 20 to 40% by quantity, and toner particles having a diameter not less than 12.7 μm in an amount of from 0 to 1.0% by weight, and wherein the toner satisfies the following relationship:

$$1.04 \leqq D4/D1 \leqq 1.30,$$

wherein D4 represents the weight average particle diameter and D1 represents a number average particle diameter of the toner; and a carrier;

a transfer device configured to transfer the toner image on the latent image bearing member to a transfer material; and a cleaning device configured to clean the latent image bearing member.

12. A process cartridge comprising:

an image bearing member configured to bear a latent image; and a developing device to develop the latent image with the toner of claim 1;

wherein the process cartridge is detachably attachable to an image forming apparatus.

13. A toner manufacturing method, comprising:

mixing raw materials comprising a binder resin and a colorant to obtain a toner composition mixture;

kneading the toner composition mixture;

pulverizing the kneaded toner composition mixture with a counter air pulverizer to obtain a toner powder; and classifying the toner powder to obtain the toner, wherein the toner has a weight average particle diameter of from 4 to 7 μm and comprises toner particles having a circle equivalent diameter of from 0.6 to 2.0 μm in an amount not greater than 5% by quantity, toner particles having a particle diameter of from 3.17 to 4.00 μm in an amount of from 10 to 40% by quantity, toner particles having a diameter of from 4.00 to 5.04 μm in an amount of from 20 to 40% by quantity, and toner particles having a diameter not less than 12.7 μm in an amount of from 0 to 1.0% by weight, and wherein the toner satisfies the following relationship:

$$1.04 \leqq D4/D1 \leqq 1.30,$$

wherein D4 represents the weight average particle diameter and D1 represents a number average particle diameter of the toner.

14. The toner manufacturing method according to claim 13, wherein fine toner powder produced in the pulverization or the classification is reused as the toner composition mixture in the kneading step.

15. The toner manufacturing method according to claim 13, further comprising:

mechanically pulverizing the toner composition mixture prior to the counter air pulverization.

16. The toner manufacturing method according to claim 15, wherein the toner powder obtained at the mechanical pulverization has at least one of a weight average particle diameter and a mode particle diameter in the range of from 5 to 15 μm.

17. The toner manufacturing method according to claim 16, wherein the classifying comprises:

supplying the toner powder into a classification room formed by a classification cover having a first conical form and a classification board having a second conical form disposed under the classification cover; and supplying air through an air inlet formed in each of a plurality of louvers which are circularly arranged between an undersurface of the first conical form of the classification cover and a top surface of the second conical form of the classification board at an outer circumference of the classifying room to whirl the second toner powder and to discharge a coarse toner powder through a coarse toner powder discharging mouth formed around the classifying board and to discharge a fine toner powder from a fine toner powder discharging tube connected to a center of the classifying board using a centrifugal force.

* * * * *